United States Patent [19]

Tairadate

[11] 4,250,791

[45] Feb. 17, 1981

[54] KEY MECHANISM FOR MUSICAL WIND INSTRUMENTS

[75] Inventor: Katsutoshi Tairadate, Hamamatsu, Japan

[73] Assignee: Nippon Gakki Seizo Kabushiki Kaisha, Japan

[21] Appl. No.: 16,331

[22] Filed: Feb. 26, 1979

[30] Foreign Application Priority Data

Feb. 25, 1978 [JP] Japan ..... 53-23617

[51] Int. Cl.[3] ..... G10D 7/08; G10D 9/04

[52] U.S. Cl. ..... 84/385 R; 84/380 R

[58] Field of Search ..... 84/385 R, 380 R, 382, 84/384

[56] References Cited

U.S. PATENT DOCUMENTS

| | | | |
|---|---|---|---|
| 2,180,118 | 11/1939 | Loney | 84/385 |
| 2,710,558 | 6/1955 | Lefevre-Selmer | 84/385 |
| 3,857,317 | 12/1974 | Carree | 84/380 |
| 3,865,005 | 2/1975 | Carree | 84/385 |

FOREIGN PATENT DOCUMENTS

| | | | |
|---|---|---|---|
| 321082 | 10/1929 | United Kingdom | 84/385 |

*Primary Examiner*—J. V. Truhe
*Assistant Examiner*—Shelley Wade
*Attorney, Agent, or Firm*—Ostrolenk, Faber, Gerb & Soffen

[57] ABSTRACT

A key mechanism for musical wind instruments such as a saxophone is comprised of a plurality of, generally four sets of, collectively arranged flat finger pieces at least one of which is provided with a sinking incline in a rim portion adjacent to neighboring finger piece or pieces in order to enable smooth shifting of the little finger point on the key mechanism. More preferable, at least one of the finger pieces is provided with a rising incline in a rim portion remote from neighboring finger piece or pieces in order to block excessive finger point shifting.

31 Claims, 11 Drawing Figures

Fig. 5A
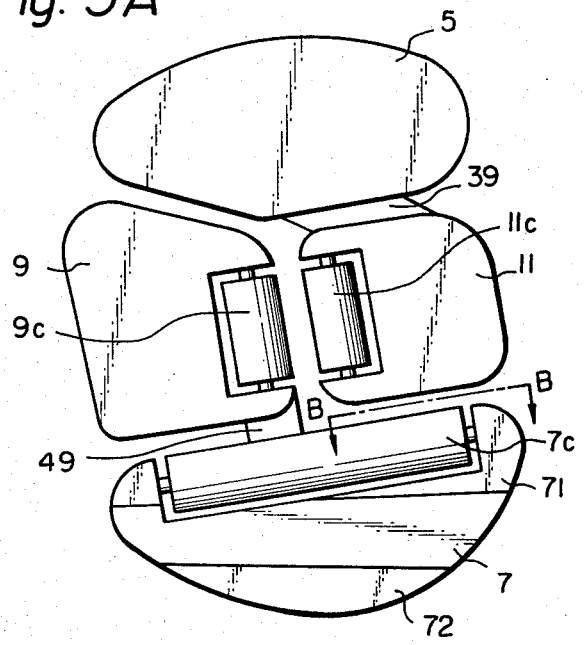
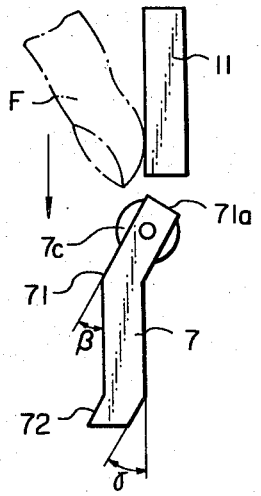
Fig. 5B

KEY MECHANISM FOR MUSICAL WIND INSTRUMENTS

BACKGROUND OF THE INVENTION

The present invention relates to an improved key mechanism for musical wind instruments, and more particularly relates to an improvement in construction of a key mechanism for musical wind instruments such as a saxophone.

The key mechanism of the above-described type generally includes a plurality of, more specifically four sets of, collectively arranged finger pieces of a substantially flat construction. Different finger pieces are for different tonal pitches. The finger pieces are arranged over the peripheral surface of a tube of the musical wind instrument.

In the following description, the side of the finger pieces adjacent to the tube surface will be referred to as "the rear side" whereas the side remote from the tube surface will be referred to as "the foreside".

The foreside surface of the finger pieces are substantially in a column plane tangential to the tube surface so that they can be operated, i.e. depressed, selectively by the left hand little finger point or tip of a player. The key mechanism further includes key arms for coupling the finger pieces to respective rotatable rods which are rotatably mounted to the tube surface.

For selective depression of the finger pieces, the little finger point needs to be shifted from piece to piece very quickly during performance of the instrument and, in most cases, this finger shifting has to be practiced without the player watching the key mechanism.

When a finger piece is depressed by the little finger point, that finger piece sinks from the above-described common plane and a level gap is formed between that finger piece and neighbouring finger pieces. This level gap hampers smooth shifting of the little finger point from a hitherto depressed finger piece to a neighbouring finger piece.

In order to facilitate the above-described finger shifting, one conventional key mechanism further includes, as later described in more detail, one or more rotatable rollers each arranged in a recess formed in a rim portion of a finger piece adjacent to the neighbouring finger piece. Though rotation of the roller somewhat mitigates difficulty in finger shifting, this construction cannot fully eliminate undesirable hindrance to smooth finger shifting.

The other conventional key mechanism includes modifications in design of a rim portion of a finger piece adjacent to a neighbouring finger piece. However, this modifications result in complicated constructions of the finger pieces which are naturally disadvantageous in economy.

The little finger point is generally shifted very quickly from piece to piece on the key mechanism without the player watching the operating hand. Therefore, the little finger point may accidentally drops off the key mechanism as a result of quick shifting.

In the conventional key mechanism, no countermeasure is employed in order to effectively prevent such a finger point dropping off the key mechanism.

SUMMARY OF THE INVENTION

It is one object of the present invention to provide a key mechanism for musical wind instruments which assures ideally smooth shifting of the little finger point.

It is another object of the present invention to provide a key mechanism for musical wind instruments which enables smooth finger shifting despite very simple construction and easy manufacturing.

It is another object of the present invention to provide a key mechanism for musical wind instrument which effectively prevents the little finger point from dropping off the key mechanism even when the finger point is quickly shifted.

In accordance with the present invention, at least one finger piece is provided with a sinking incline in a rim portion adjacent to a neighbouring finger piece or pieces.

In a preferred embodiment, at least one finger piece may be provided with a rising incline in a rim portion remote from a neighbouring finger piece or pieces.

BRIEF DESCRIPTION OF THE DRAWINGS

FIG. 5A is an enlarged side view of another embodiment of the key mechanism in accordance with the present invention with unrelated parts being omitted, FIG. 5B is a view seen in the direction B—B in FIG. 5A for showing the finger shifting mode from the fourth to second finger pieces on the key mechanism shown in FIG. 5A.

DESCRIPTION OF PREFERRED EMBODIMENTS

Figure 1:
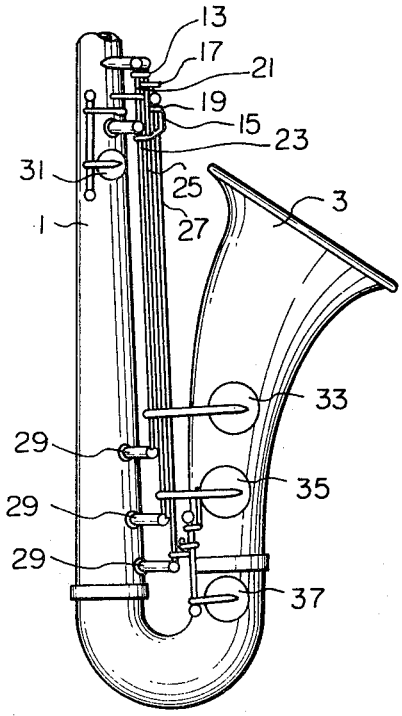
FIG. 1 is a side view of a saxophone to which the present invention is advantageously applied.

FIG. 1 shows a saxophone as a typical example of the musical wind instruments to which the present invention is advantageously applied.

The saxophone takes the shape of an approximately J-shaped conical, usually brass tube 1 which diverges gradually from the mouth piece side to the bell side.

The diverging end of the tube 1 forms a bell 3 opening upwards in the illustration while the other end of the tube 1 is provided with a mouth piece (not shown) having a reed.

More specifically in FIG. 2, which shows later described prior art for the invention, the tube 1 is provided with four sets of finger pieces 5, 7, 9 and 11 collectively forming a key mechanism on one side thereof. Different finger pieces 5 through 9 correspond to different tonal pitches. In the illustrated embodiment, the first finger piece 5 is for the note G♯ (G-sharp), the second finger piece 7 for the note B♭ (B-flat), the third finger piece 9 for the note B and the fourth finger piece 11 for the note C♯ (C-sharp). The first and second finger pieces 5 and 7 are spaced apart from each other along the length of the tube 1 with the first finger piece 5 being closest to the mouth piece end and the second finger piece 7 being closest to the bell end. The third and fourth finger pieces 9 and 11 are arranged in the space between the first and second finger pieces 5 and 7 in a somewhat spaced side-by-side arrangement to each other. The finger pieces 5 through 11 take the form of particularly shaped flat plates adapted for selective operation by the left hand little finger of a player. Further, the four finger pieces 5 through 11 are arranged so that their foreside surfaces are substantially in a common plane which is tangential to the peripheral surface of the tube 1.

The finger pieces 5 through 11 are coupled, via respective key arms 13, 15, 17 and 19, to rotatable rods 21, 23, 25 and 27 extending logitudinally of the tube 1, respectively. The rods 21 through 27 are rotatably supported by respective bearing posts 29, which are mounted to the side of the tube 1, respectively. The other ends of the rotatable rods 21 through 27 extend near the curved apex of the J-shaped tube 1 and are provided with pads 31, 33, 35 and 37, respectively. Different pads 31 through 37 are adapted for covering tone holes (not shown) formed in the tube 1, with different tone holes corresponding to the above-described different notes, i.e. G♯, B♭, B and C♯.

On the rear side of the key mechanism, a connecting plate 39 is secured at one end to the first finger piece 5 and is extended to contact, at the other end, the rear side of the fourth finger piece 11. Due to the existence of the connecting plate 39, finger operation on, i.e. depression of, the fourth finger piece 11 induces simultaneous and automatic depression of the first finger piece 5. For a like purpose, the key arm 13 for the first finger piece 5 is arranged in partial contact with the rear side surface of the third finger piece 9 so that depression of the third key 9 induces simultaneous and automatic depression of the first key 5. Further, a connecting plate 49 is secured at one end to the third finger piece 9 and is extended to contact, at the other end, the rear side of the second finger piece 7 so that depression of the second finger piece 7 induces simultaneous and automatic depression of the first and third keys 5 and 9. With the above-described construction, only the first finger piece 5 can be finger operated separately from other finger pieces 7 through 11.

It is clear that depression of the finger pieces causes corresponding swing of an associated key arm and the latter in turn causes corresponding axial rotation of an associated rotatable rod, whereby the position of an associated pad with respect to its corresponding tone hole is changed for control. Assuming, for example, that finger operation is applied to the third finger piece 9, depression of the third and first finger pieces 9, 5 takes place so that the corresponding key arms 17 and 13 swing. Then the corresponding axial rotation occurs on the third and first rotatable rods 25, 21 so that the positions of the pads 35 and 31 for the B and G sharp holes can be controlled.

As explained already, the foreside surfaces of the four finger pieces 5 through 11 are all in the common plane tangential to the peripheral surface of the tube 1 (hereinafter referred to merely as "the normal common surface plane" and are selectively operated by the left hand little finger of the player. For this selective operation, the little finger point must be shifted from finger piece to finger piece very often and quickly. As briefly mentioned already, it is rather difficult with the conventional key mechanism construction to shift the little finger point from piece to piece quickly and smoothly. This shifting is particularly difficult when the little finger point is to be shifted from the fourth to the second finger pieces 11, 7 and from the fourth to the third finger pieces 11, 9.

Figure 3:
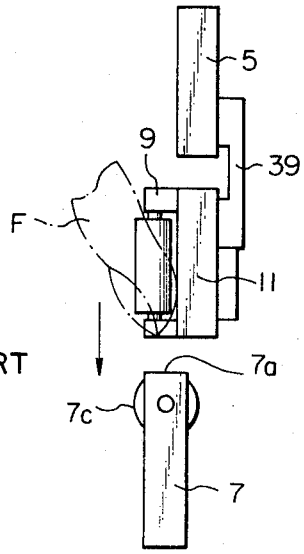
Fig. 3 PRIOR ART
FIG. 3 is a view seen in the direction III—III in FIG. 2 for showing one example of finger shifting mode on the key mechanism shown in FIG. 2.

More specifically, FIG. 3 shows a shifting mode in which the little finger point F should be shifted from the fourth to the second finger pieces 11, 7 during the performance of the instrument. In the illustrated disposition, the foreside surfaces of the fourth and first finger pieces 11, 5 are depressed off the normal common surface plane due to pressure on the fourth finger piece 11 by the little finger point F whereas the foreside surfaces of the second and third finger pieces 7, 9 are in the normal common surface plane. When the little finger point F is moved in the direction of the arrow in order to shift same onto the second finger piece 7, movement of the little finger point F is hampered by contact with the rim *7a* of the second finger piece 7 which is caused by the gap in the foreside surface. This causes uncomfortable pressure on the player's little finger since the saxophone is normally used in a substantially vertical state and the position of the second finger piece 7 is below that of the fourth finger piece 11 and, therefore, the little finger is moved downwardly in order to carry out the desired shift.

In order to avoid this hindrance due to the surface gap, it is necessary to remove the little finger point F from the fourth finger piece 11, move that finger point to the level of the normal common surface plane, shift same onto the second finger piece 7 and finally press the second finger piece 7. Apparently this kind of complicated finger movement is unsuited for quick and frequent finger shifting on the key mechanism during performance of the instrument. Similar trouble occurs when the little finger point F should be shifted from the fourth to the third finger points 11, 9.

In order to eliminate the above-described disadvantage in finger shifting inherent to the prior art, it has been proposed in the art to form recesses in the rim portions of the finger pieces each other. More specifically, in FIG. 2, the second finger piece 7 is provided with a recess *7b* formed in the rim portion thereof on the side confronting the third and fourth finger pieces 9, 11, and a roller *7c* rotatably arranged in the cut-out with the axis thereof being substantially parallel to the rim *7a*. Likewise, the third finger piece 9 is provided with a recess *9b* formed in the rim portion thereof on the side confronting or facing toward the fourth finger piece 11, and a roller *9c* is rotatably arranged in the recess *9b* with the axis thereof being substantially parallel to the rim. Further, the fourth finger piece 11 is provided with a recess *11b* formed in the rim portion thereof on the side confronting or facing toward the third finger piece 9, and a roller 11*c* is rotatably arranged in the recess 11*b* with the axis thereof being substantially parallel to the rim. This proposed construction may somewhat assist smooth finger shifting thanks to rotation of the rollers 7*c* through 11*c*. However, when the main shifting locus of the little finger point F intersects the axis of rotation of the roller in question (see FIG. 3) instead of being eccentric to that axis, a smooth rotation of the roller is liable to be blocked to form a bar to smooth finger shifting.

For a similar purpose, an improved construction of the key mechanism is proposed in German Patent Publication No. 2412805, in which the rim portion of the second finger piece 7 confronting or facing forward the fourth finger piece 11 is separated from and pivotally connected to the main portion in such an arrangement that the rim portion of the second finger piece 7 is movable together with the fourth finger piece 11. With this construction, depression of the fourth finger piece 11 causes corresponding swiveling of the rim portion of the second finger piece 7, thereby providing a kind of sloped bridge between the fourth finger piece 11 and the main portion of the second finger piece 7. The little finger point F can shift rather smoothly from the fourth to the second finger pieces 11, 7 while sliding upon this sloped bridge, i.e. the rim portion of the second finger piece 7.

However, the complicated construction of this key mechanism leads to increased cost in production of the saxophone. In addition, since the separate rim portion acts as a new additional finger piece, depression of either of the second and fourth finger pieces 9, 11 may cause unnecessary depression of other finger pieces depending on the location whereat each finger piece 9 or 11 is pressed by the little finger point F. Highly skilled technique in operation is required in order to avoid this trouble.

A further proposal is given in U.S. Pat. No. 2,710,558 in order to allow the smooth shifting of the little finger point during performance of the instrument. In this case, a curved plate is arranged so as to move together with the second finger piece 7 and to be spaced away from and surround the outer rim of the fourth finger piece 11. The curved plate is operationally connected to the fourth finger piece 11. With this construction, depression of the fourth finger piece 11 induces tilting movement of the second finger piece 7, thereby enabling smooth finger shifting from the fourth to the second finger pieces 11, 9.

This proposed construction, however, is inevitably accompanied with disadvantages similar to those of the above-described German Patent Publication, i.e. high production cost and highly skilled technique in operation on the instrument.

Figure 4A:
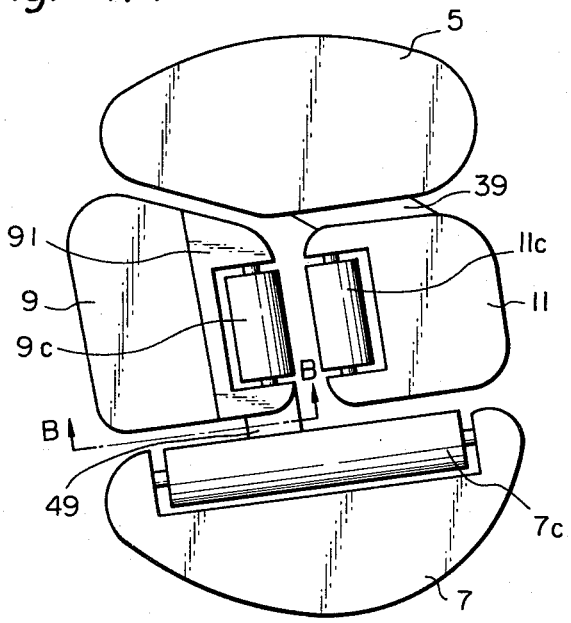
FIG. 4A is an enlarged side view of one embodiment of the key mechanism in accordance with the present invention with unrelated parts being omitted.
Figure 4B:
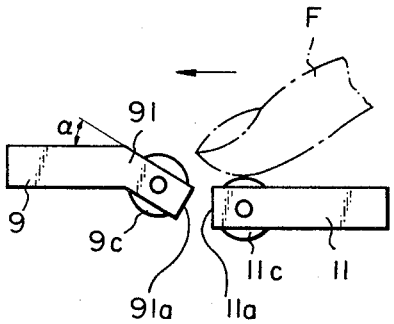
FIG. 4B is a view seen in the direction B—B in FIG. 4A for showing the finger shifting mode from the fourth to third finger pieces on the key mechanism shown in FIG. 4A.

One embodiment of the key mechanism in accordance with the present invention is shown in FIGS. 4A and 4B, in which parts of the key mechanism unrelated to the gist of the invention are omitted for simplified illustration and parts substantially similar in construction and operation to those used in the conventional key mechanisms are designated with similar reference numerals and symbols.

Like the conventional construction, the key mechanism includes four sets of finger pieces 5 through 11 and two sets of connecting plates 39 and 49, and the second to fourth finger pieces 7, 9, 11 are provided with rollers 7*c*, 9*c*, 11*c*, in the respective rim portion recess 7*b*, 9*b*, 11*b*.

The inner rim portion of the third finger piece 9 confronting or facing toward the fourth finger piece 11 is formed into an incline 91 sloping towards the rear side and towards the fourth finger piece 11 at a given angle of inclination. It is preferable that the inner rim 91*a* of the incline 91 be located near the corresponding inner rim 11*a* of the fourth finger piece 11 in the depressed state. In a practical example, the proper angle of inclination $\alpha$ for the third finger piece incline 91 is about 30 degrees. When taken in a direction substantially normal to the inner rim 91*a* of the incline 91, the preferable length of the incline 91 is about 5.0 mm. for the finger piece 9 of 17.5 mm. entire length.

The mode of shifting the little finger point F from the fourth to the third finger pieces 11, 9 is shown in detail in FIG. 4B. When the little finger point F is to be shifted from the hitherto to depressed fourth finger piece 11 in the direction shown with an arrow, the little finger point F can easily ride on the roller 9*c* of the third finger piece 9 since the inner rim 91*a* of the incline 91 is located quite near the inner rim 11*a* of the fourth finger piece 11.

Another embodiment of the key mechanism in accordance with the present invention is shown in FIGS. 5A and 5B, in which the key mechanism also includes four sets of finger pieces 5 through 11 and two sets of connecting plates 39 and 49, and the second to fourth finger pieces 7, 9, 11 are provided with rollers 7*c*, 9*c*, 11*c* in the respective rim portion recesses 7*b*, 9*b*, 11*b*.

The inner rim portion of the second finger piece 7 confronting or facing toward the third and fourth finger pieces 9, 11 is formed into a first incline 71 sloping towards the rear side and towards the third and fourth finger pieces 9, 11 at a given angle of inclination $\beta$. It is preferable that the inner rim 71*a* of the incline 71 should be located near the corresponding adjacent side rims of the third and fourth finger pieces 9, 11 in the depressed state. In a practical example, the proper angle of inclination $\beta$ for the second piece first incline 71 is about 35 degrees. The outer rim portion of the second finger piece 7 is formed into a second incline 72 sloping towards the foreside at a given angle of inclination $\gamma$. This second incline 72 acts as a kind of finger stopper so that the little finger point F should not drop off the key mechanism during quick shifting. In a practical example, the proper angle of inclination $\gamma$ for the second piece second incline 72 is about 35 degrees.

The mode of shifting the little finger point F from the fourth to the second finger pieces 11, 7 is shown in detail in FIG. 5B. When the little finger point F is to be shifted from the hitherto depressed fourth finger piece 11 down in the direction shown with an arrow, the little finger point F can easily ride on the roller 7*c* of the second finger piece 7 since the inner rim 71*a* of the first incline 71 is located quite near the side rim of the fourth finger piece 11. In addition, excessive shifting of the little finger point F in the direction of the arrow can be well prevented by the presence of the second incline 72 so that the little finger point F should not drop off the key mechanism through inadvertency.

Figure 6:
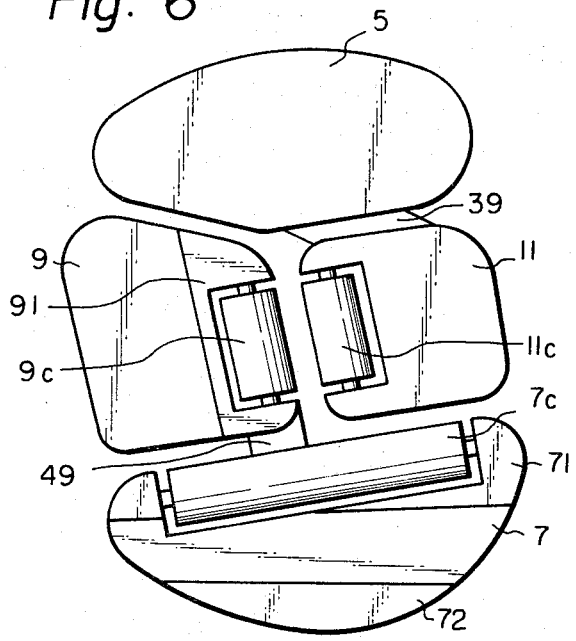
FIG. 6 is an enlarged side view of yet another embodiment of the key mechanism in accordance with the present invention with unrelated parts being omitted.

The other embodiment of the key mechanism in accordance with the present invention is shown in FIG. 6, in which the key mechanism again includes four sets of finger pieces 5 through 11 and two sets of connecting plates 39 and 49, and the second to fourth finger pieces 7, 9, 11 are provided with rollers 7*c*, 9*c*, 11*c* in the respective rim portion recesses 7*b*, 9*b*, 11*b*. The second and third finger pieces 7 and 9 are both provided with respective inclines 71, 72 and 91.

Little finger shifting from the fourth to third finger pieces 11, 9 is carried out in the mode shown in FIG. 4B whereas that from the fourth to second finger piece 11, 7 is carried out in the mode shown in FIG. 5B.

Figure 7A:
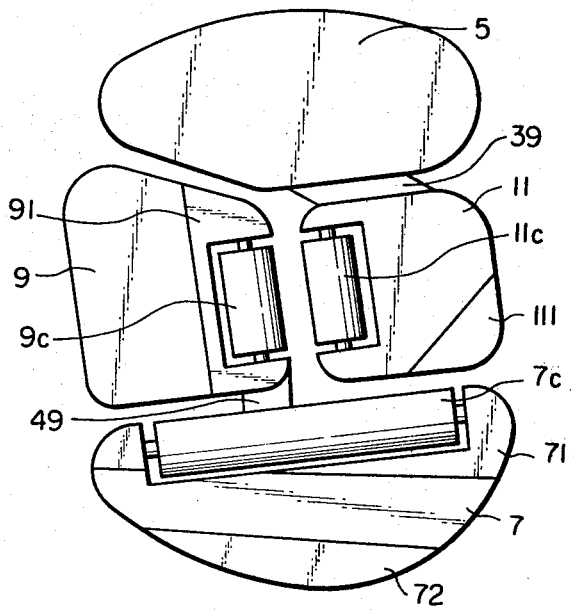
FIG. 7A is an enlarged side view of a further embodiment of the key mechanism in accordance with the present invention with unrelated parts being omitted.
Figure 7B:
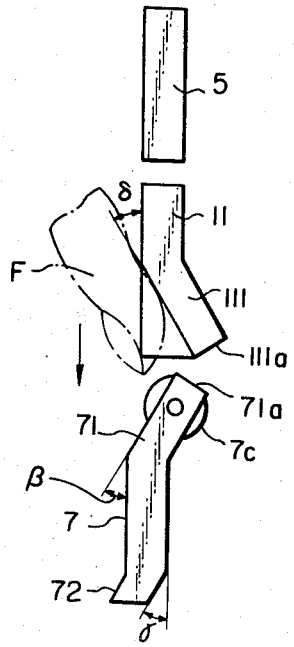
FIG. 7B is a view seen in the direction B—B in FIG. 7A for showing the finger shifting mode from the fourth to second finger pieces on the key mechanism shown in FIG. 7A.

A further embodiment of the key mechanism in accordance with the present invention is shown in FIGS. 7A and 7B, in which, like the foregoing embodiments, the key mechanism includes four sets of finger pieces 5 through 11 and two sets of connecting plates 39 and 49, and the second to the fourth finger pieces 7, 9, 11 are provided with rollers 7*c*, 9*c*, 11*c* arranged in the respective rim portion recesses 7*b*, 9*b*, 11*b*. The second and third finger pieces 7, 9 are both provided with respective inclines 71, 72 and 91. In addition thereto, the fourth finger piece 11 is also provided with an incline 111 sloping towards the rear side at an outer corner portion facing the inner rim of the second finger piece 7. Preferably, the rim 111*a* of the corner portion incline 111 should be located near the inner rim 71*a* of the second finger piece first incline 71. In a practical example, the proper angle of inclination $\delta$ for the corner portion incline 111 is about 30 degrees.

The mode of shifting the little finger point F from the fourth to second finger piece 11, 7 is shown in detail in FIG. 7B. When the little finger point F is to be shifted from the hitherto depressed fourth finger piece 11 down in the direction shown with an arrow, the little finger point F can easily ride on the roller 7*c* of the second finger piece 7 since the inner rim 71*a* of the second finger piece incline 71 is located quite near the rim 111*a* of the fourth finger piece corner incline 111. It is clear from the illustration in FIG. 7B that reverse shifting of the little finger point F, i.e. shifting from the second to the fourth finger piece 7, 11, can be carried out quite smoothly due to the absence of any gap between the facing rims 71*a* and 111*a*.

Figure 2:
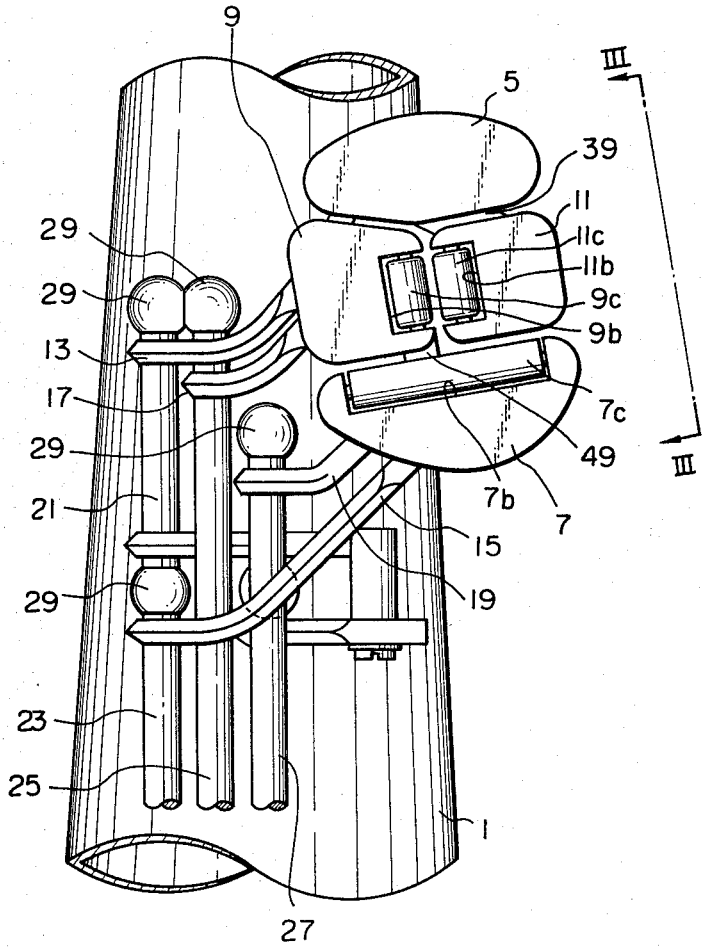
Fig. 2 PRIOR ART
FIG. 2 is an enlarged side view of the conventional key mechanism and its related parts on the saxophone shown in FIG. 1.
Figure 8:
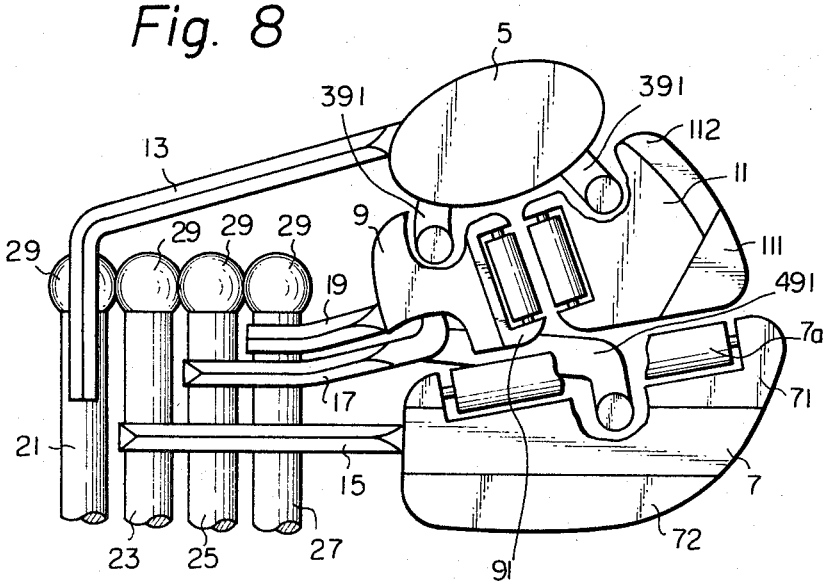
FIG. 8 is a side view of a further embodiment of the key mechanism in accordance with the present invention, wherein finger pieces are partly cut off for easy understanding of the construction.

A still further embodiment of the key mechanism is shown in FIG. 8, in which, although it is basically similar in construction and function, arrangement of the key arms 13 to 19 and the rotatable rods 21 to 27 somewhat differ from those shown in FIG. 2, but this difference is a rather trivial change in the design.

The second to fourth finger pieces 7, 9, 11 are also provided with their inclines 71, 72, 91, 111, respectively. In this embodiment, however, the fourth finger piece 11 is provided, in addition to the sinking incline 111, with a rising incline 112 formed in the outer rim portion thereof, which slopes outwards and towards the foreside.

When the little finger point F is shifted from the third to the fourth finger piece 9, 11, the presence of the rising incline 112 effectively prevents dropping of the little finger point F off the fourth finger piece 11 during quick shifting. In a practical example, the proper angle of inclination $\epsilon$ for the rising incline 112 is about 10 degrees.

With the above-described construction, depression of the first finger piece 5 causes no corresponding depression of any other finger piece as the ends of the connector 391 separate from the third and fourth finger pieces 9, 11 only. Depression of the second finger piece 7 causes simultaneous depression of the third finger piece 9 via the connector 491 and this simultaneous depression of the third finger piece 9 induces further simultaneous depression of the first finger piece 5 via the connector 391. Depression of either of the third and fourth finger pieces 9, 11 causes simultaneous depression of the first finger piece 5.

As is clear from the foregoing description, the key mechanism of the present invention is very simple in its construction. In addition, the inclines on the finger pieces can be very easily formed by simply bending the concerned rim portions of the relatively thin finger pieces. Despite such simplicity in construction and formation, the key mechanism of the present invention assures ideally smooth finger shifting from piece to piece and effectively prevents undesirable dropping of the little finger point off the key mechanism during quick shifting.

In the third embodiment, the inclines are formed on the second and third finger pieces whereas they are formed on the second to fourth finger pieces in the fourth and fifth embodiments. In addition to these arrangements, various combinations of the finger pieces having respective inclines may be designed by one skilled in the art on the basis of the above-described basic concept of the present invention. Likewise, the connections between the four finger pieces may be modified in accordance with the requirements in actual use of the key mechanism of the present invention.

I claim:

1. Improved key mechanism for musical wind instruments comprising a plurality of collectively arranged finger pieces for controlling tone holes of an instrument and the finger pieces having respective foreside surfaces, respective opposite rear sides and respective peripheral rims, at least one of said finger pieces having rim portions around said rim thereof and being provided with a sinking incline in one said rim portion which is adjacent to a neighbouring said finger piece, said sinking incline sloping towards the rear side and towards the corresponding rim of the respective said one finger piece;

said one finger piece having a recess formed in said sinking incline in said one rim portion, a rotatable roller received in said recess and rotatably supported on said finger piece and the axis of rotation of said roller being substantially in parallel to the corresponding said rim of said finger piece.

2. Improved key mechanism as claimed in claim 1 in which at least one of said finger pieces is provided with a rising incline in a said rim portion that is remote from a neighbouring said finger piece, said rising incline sloping towards said foreside and towards the corresponding said rim portion of said finger piece.

3. Improved key mechanism as claimed in claim 1 in which at least one said finger piece is provided on said rear side thereof with an elongated connector having a free end in contact with said rear side of another said finger piece, whereby depression of said another finger piece causes simultaneous depression of said one finger piece.

4. Improved key mechanism for musical wind instruments, comprising:

a plurality of collectively arranged finger pieces for controlling tone holes of an instrument, said finger pieces having respective foreside surfaces and respective rear sides and respective peripheral rims, said finger pieces of said plurality each being arranged adjacent other of said finger pieces of said plurality for permitting a finger to easily move between said foresides of adjacent said finger pieces, said finger pieces each having rim portions around said rim thereof, at least one said finger piece having a first said rim portion and also having another main portion to which said first rim portion is connected; said first rim portion is adjacent a second said rim portion on an adjacent other said finger piece;

means supporting each said finger piece to the musical instrument for enabling each said finger piece to be moved toward the rear of that said finger piece and for permitting the said other finger piece to be moved to the rear with respect to the said one finger piece;

said foreside of said one finger piece at said first rim portion thereof being sunk to the rear of that said finger piece with respect to said foreside of said one finger piece at said main portion, and the level to which said first rim portion is sunk to the rear is selected so that when said other finger piece is depressed to the rear by a finger, said first rim portion, at least where it is adjacent to said second rim portion, is depressed to the rear to substantially the same extent as said second rim portion on the depressed said other finger piece for enabling an easy transition for finger movement from said foreside surface of said other finger piece, over the adjacent second and first said rim portions to said foreside surface of said one finger piece, and so that when said first and said second finger pieces are not depressed to the rear, said foreside surface of said one finger piece at said first rim portion is normally located to the rear of said foreside surface of said second finger piece, at least where said first rim portion is adjacent to said second rim portion.

5. Improved key mechanism as claimed in claims 1, 3 or 4 in which said plurality comprises four said finger pieces arranged collectively, including first and second finger pieces spaced apart from each other substantially in the longitudinal direction of the instrument, third and fourth finger pieces arranged in the space between said first and second finger pieces and in a side-by-side relationship to each other, and neighbouring finger pieces are somewhate spaced apart from each other along their facing rim portions. somewhat spaced apart from each other along their facing rims.

6. Improved key mechanism as claimed in claim 5 in which said second finger piece is provided with said sinking incline in portion adjacent to said third and fourth finger pieces.

7. Improved key mechanism as claimed in claim 6 in which said second finger piece is further provided with a rising incline in a said rim portion remote from said third and fourth finger pieces, said rising incline sloping toward said foreside and towards the corresponding said rim portion of said second finger piece.

8. Improved key mechanism as claimed in claim 5 in which said third finger piece is provided with said sinking incline in said rim portion adjacent to said fourth finger piece.

9. Improved key mechanism as claimed in claim 5 in which said fourth finger piece is provided with said sinking incline in a said rim portion at a corner thereof and adjacent to said second finger piece.

10. Improved key mechanism as claimed in claim 9 in which said fourth finger piece is further provided with a rising incline in a said rim portion remote from said third finger piece, said rising incline sloping towards said foreside and towards the corresponding said rim portion of said fourth finger piece.

11. Improved key mechanism as claimed in claim 5 in which said second finger piece is provided with said sinking incline in a said rim portion adjacent to said third and fourth finger pieces, and said third finger piece is provided with said sinking incline in a said rim portion adjacent to said fourth finger piece.

12. Improved key mechanism as claimed in claim 11 in which said second finger piece is further provided with a rising incline in a said rim portion remote from said third and fourth finger pieces, said rising incline sloping towards said foreside and towards the corresponding said rim portion of said second finger piece.

13. Improved key mechanism as claimed in claim 5 in which said third finger piece is provided with said sinking incline in a said rim portion adjacent to said fourth finger piece, and said fourth finger piece is provided with said sinking incline in a said rim portion at a corner thereto adjacent to said second finger piece.

14. Improved key mechanism as claimed in claim 13 in which said fourth finger piece is further provided with a rising incline in a said rim portion remote from said third finger piece, said rising incline sloping towards said foreside and towards the corresponding said rim portion of said fourth finger piece.

15. Improved key mechanism as claimed in claim 5 in which said fourth finger piece is provided with said sinking incline in a said rim portion at a corner thereof adjacent to said second finger piece, and said second finger piece is provided with said sinking incline in a said rim portion adjacent to said third and fourth finger piece.

16. Improved key mechanism as claimed in claim 15 in which said fourth finger piece is further provided with a rising incline in a said rim portion remote from said third finger piece, said rising incline sloping towards said foreside and towards the corresponding said rim portion of said fourth finger piece.

17. Improved key mechanism as claimed in claim 15 in which said second finger piece is further provided with a rising incline in a said rim portion remote from said third and fourth finger pieces, said rising incline sloping towards said foreside and towards the corresponding said rim portion of said second finger piece.

18. Improved key mechanism is claimed in claim 15 in which said fourth finger piece is further provided with a rising incline in a said rim portion remote from said third finger piece, said rising incline sloping towards said foreside and towards the corresponding said rim portion of said fourth finger piece.

19. Improved key mechanism as claimed in claim 5 in which said second finger piece is provided with said sinking incline in a said rim portion adjacent to said third and fourth finger pieces, said third finger piece is provided with said sinking incline in a said rim portion adjacent to said fourth finger piece, and said fourth finger piece is provided with said sinking incline in a said rim portion at a corner thereof adjacent to said second finger piece.

20. Improved key mechanism as claimed in claim 19 in which said second finger piece is further provided with a rising incline in a said rim portion remote from said third and fourth finger pieces, said rising incline sloping towards said foreside and towards the corresponding said rim portion of said second finger piece.

21. Improved key mechanism as claimed in claim 19 in which said fourth finger piece is further provided with a rising incline in a said rim portion remote from said third finger piece, said rising incline sloping towards said foreside and towards the coresponding said rim portion of said fourth finger piece.

22. Improved key mechanism as claimed in claim 19 in which said second finger piece is further provided with a rising incline in a said rim portion remote from said third and fourth finger pieces, said rising incline sloping towards said foreside and towards the corresponding said rim portion of said second finger piece, and said fourth finger piece is further provided with a rising incline in a said rim portion remote from said third finger piece, said rising incline sloping towards said foreside and towards the corresponding said rim portion of said fourth finger piece.

23. Improved key mechanism as claimed in claim 5 in which said first finger piece is provided on said rear side with an elongated connector including a free end in contact with said rear side of said fourth finger piece, whereby depression of said fourth finger piece causes simultaneous depression of said first finger piece.

24. Improved key mechanism as claimed in claim 5 in which said third finger piece is provided on said rear side with an elongated connector including a free end in contact with said rear side of said second finger piece, whereby depression of said second finger piece causes simultaneous depression of said third finger piece.

25. Improved key mechanism as claimed in claim 5 including a key arm for said first finger piece and which is in contact with said rear side of said third finger piece, whereby depression of said third finger piece causes simultaneous depression of said first finger piece.

26. Improved key mechanism as claimed in claim 5 in which said first finger piece is provided on said rear side thereof with an elongated connector including a free end in contact with said rear side of said fourth finger piece, said third finger piece is provided on said rear side thereof with an elongated connector including a free end in contact with said rear side of said second finger piece, and a key arm for said first finger piece and which is in contact with said rear side of said third finger piece, whereby depression of said second finger piece causes simultaneous depression of said third and fourth finger pieces, and depression of either of said third and fourth finger pieces causes simultaneous depression of said first finger piece.

27. Improved key mechanism as claimed in claim 5 in which said first finger piece is provided on said rear side thereof with an arched connector including free ends which are in contact with said rear sides of said third and fourth finger pieces, whereby depression of either of said third and fourth finger pieces cause simultaneous depression of said first finger piece.

28. Improved key mechanism as claimed in claim 5 including a key arm for said third finger piece, said key arm including an elongated connector having a free end which is in contact with said rear side of said second finger piece, whereby depression of said second finger piece causes simultaneous depression of said third finger piece.

29. Improved key mechanism as claimed in claim 5 in which said first finger piece is provided on said rear side thereof with an arched connector including free ends which are in contact with said rear sides of said third and fourth finger pieces, and a key arm for said third finger piece, said key arm including an elongated connector having a free end which is in contact with said rear side of said second finger piece, whereby depression of said second finger piece causes simultaneous depression of said first and third finger pieces, and depression of either of said third and fourth pieces causes simultaneous depression of said first finger piece.

30. Improved key mechanism as claimed in claim 4, in which said first rim portion foreside surface is gradually inclined to the rear of said foreside surface of said main portion of said first finger piece.

31. Improved key mechanism as claimed in either of claims 4 or 30, in which said sunk first rim portion is supported to permanently have the sunken orientation thereof as said first finger piece is moved to the rear and returns.

* * * * *